US007896716B2

(12) United States Patent
Imanaka et al.

(10) Patent No.: US 7,896,716 B2
(45) Date of Patent: Mar. 1, 2011

(54) HYDRAULIC SAILDRIVE APPARATUS

(75) Inventors: Toshio Imanaka, Amagasaki (JP); Osamu Matsumoto, Amagasaki (JP)

(73) Assignee: Yanmar Co., Ltd., Osaka (JP)

( * ) Notice: Subject to any disclaimer, the term of this patent is extended or adjusted under 35 U.S.C. 154(b) by 456 days.

(21) Appl. No.: 12/073,475

(22) Filed: Mar. 6, 2008

(65) Prior Publication Data

US 2008/0220669 A1 Sep. 11, 2008

(30) Foreign Application Priority Data

Mar. 9, 2007 (JP) ..... 2007-059535

(51) Int. Cl.
*B63H 20/14* (2006.01)

(52) U.S. Cl. ..... 440/5; 440/75

(58) Field of Classification Search ..... 440/75, 440/5

See application file for complete search history.

(56) References Cited

U.S. PATENT DOCUMENTS

| | | | | |
|---|---|---|---|---|
| 3,872,957 | A * | 3/1975 | Maurer et al. | 192/113.34 |
| 4,993,979 | A | 2/1991 | Bland et al. | |
| 5,328,396 | A | 7/1994 | Hayasaka | |
| 5,403,218 | A | 4/1995 | Onoue et al. | |
| 5,643,025 | A * | 7/1997 | Suzuki | 440/75 |
| 5,827,145 | A * | 10/1998 | Okcuoglu | 475/88 |
| 6,779,642 | B2 * | 8/2004 | Arai et al. | 192/70.12 |

FOREIGN PATENT DOCUMENTS

| | | |
|---|---|---|
| JP | A-60-022594 | 2/1985 |
| JP | A-H03-7691 | 1/1991 |
| JP | A-H04-143195 | 5/1992 |
| JP | A-H06-221383 | 8/1994 |
| JP | A-2000-318688 | 11/2000 |

OTHER PUBLICATIONS

European Search Report issued from the European Patent Office on Nov. 5, 2009 for the corresponding European patent application No. 08004195.7-1254.

* cited by examiner

*Primary Examiner* — Stephen Avila
(74) *Attorney, Agent, or Firm* — Posz Law Group, PLC

(57) ABSTRACT

The subject invention provides a hydraulic saildrive apparatus comprising an upper unit 103 having an input shaft 1 connected to an engine 102 inside a boat, and a lower unit 104 having an output shaft 4 including a propeller shaft 2 and also having a lower portion protruding from the boat's bottom, wherein the upper unit 103 is provided with a hydraulic forward and reverse switching clutch 5 for transmitting the rotation direction of the input shaft 1 to the propeller shaft 2, the clutch 5 being capable of changing the rotation direction between forward and reverse relative to the input shaft 1.

3 Claims, 12 Drawing Sheets

HYDRAULIC SAILDRIVE APPARATUS

FIELD OF THE INVENTION

The present invention relates to a propulsion device mounted to a sailboat, more specifically to a hydraulic saildrive apparatus having a hydraulic wet multiplate clutch.

BACKGROUND ART

Among various known sailboats, a sailboat having a propulsion device, such as a stern drive, can travel in two ways: under sail using the force of wind received by a sail without operating the engine; or under power using the propulsion force of a propeller with the engine operated.

A typical sailboat propulsion device has a drive unit incorporating a clutch, a gear, a bearing and the like for transmitting the engine drive power to a propeller shaft. Even when traveling under sail with the engine not operating, the propeller rotates due to water resistance. The sailboat could go even faster when traveling under sail than under power. Therefore, in order to prevent the seizure of a clutch, gear, bearing etc., it is necessary to provide lubricating oil to sliding parts of a driveline not only when traveling under power but also when traveling under sail with the engine stopped.

In view of this objective, a saildrive system having a centrifugal pump integrated into a propeller shaft, or into a drive shaft that connects a propeller shaft and a clutch with a bevel gear, has been suggested. In this system, when the boat travels under power, lubricating oil is absorbed by the centrifugal pump from an oil reservoir in the bottom of the casing, and the pressurized oil is circulated in a lubricating oil path formed inside the casing for supply to the clutch, gear, bearing etc. This system is disclosed, for example, in Japanese Unexamined Patent Publication No. H03-7691, Japanese Unexamined Patent Publication No. H06-331838, and Japanese Unexamined Patent Publication No. 2000-318688.

Also, Japanese Unexamined Patent Publication No. H04-143195 discloses a structure in which a wet multiplate forward and reverse clutch is integrated into a drive unit of a propulsion device, and an input shaft to which engine drive power is applied is directly connected to a gear pump, which supplies lubricating oil or working oil for the clutch.

This gear pump directly connected to the input shaft is not capable of supplying lubricating oil when the engine is stopped; that is, lubricating oil is not supplied when the boat travels under sail with the engine not operating. Meanwhile, the centrifugal pump integrated into the propeller shaft or drive shaft does not work without the rotation of the propeller shaft or drive shaft. Therefore, working oil is not supplied to the hydraulic wet multiplate clutch when the boat is stopped, and the clutch cannot be engaged. In view of this defect, the existing sailboat having a centrifugal pump driven by the propeller shaft or drive shaft generally uses a cone clutch operated by a mechanical shift mechanism, instead of a hydraulic wet multiplate clutch.

However, compared with a hydraulic wet multiplate clutch, the cone clutch generates a large impact when switching between forward and reverse. Particularly, for certain types of sailboats in which it is desirable to increase the cabin area that lies adjacent to the engine room, and in which comfort is important, the engine room needs to be reduced in size to enlarge the cabin area. However, a smaller engine room more easily transmits noise to the cabin area, which can be significantly bothersome.

In view of this problem, an object of the present invention is to provide a hydraulic saildrive apparatus having a hydraulic wet multiplate clutch.

DISCLOSURE OF THE INVENTION

In order to attain the foregoing object, a hydraulic saildrive apparatus according to the present invention comprises: an upper unit having an input shaft connected to an engine inside a boat; and a lower unit having an output shaft including a propeller shaft, a lower portion of the lower unit protruding from the boat's bottom, wherein: the upper unit is provided with a hydraulic forward and reverse switching clutch for transmitting the rotation direction of the input shaft to the propeller shaft, the clutch being capable of changing the rotation direction between forward and reverse relative to the input shaft.

The hydraulic saildrive apparatus preferably further comprises a first hydraulic pump driven by the input shaft, for supplying working oil and lubricating oil to the clutch from an oil reservoir; and a second hydraulic pump that is driven by the output shaft, for supplying at least lubricating oil to the clutch from an oil reservoir.

The hydraulic saildrive apparatus preferably further comprises a second lubricating oil supply path connected to a first lubricating oil supply path for supplying lubricating oil to the clutch by the first hydraulic pump, the second lubricating oil supply path extending from the second hydraulic pump; and a check valve provided in the second lubricating oil supply path, for preventing the flow of the lubricating oil from the first lubricating oil supply path into the direction of the second hydraulic pump.

The hydraulic saildrive apparatus is preferably arranged so that a lubricating oil supply path provided by the first hydraulic pump is branched from a working oil supply path provided by the first hydraulic pump, at a downstream portion relative to the first hydraulic pump; the second hydraulic pump is formed in a part of the working oil supply path, at an upstream portion relative to the first hydraulic pump; a first bypass oil path is branched from the working oil supply path, at a point between the first hydraulic pump and the second hydraulic pump, the first bypass oil path being connected to the lubricating oil supply path; the first bypass oil path includes a first check valve for preventing the flow of the lubricating oil from the lubricating oil supply path provided by the first hydraulic pump into the direction of the second hydraulic pump; a second bypass oil path is branched from the working oil supply path, at a point between the first hydraulic pump and the second hydraulic pump, the second bypass oil path being connected to the oil reservoir; and the second bypass oil path includes a second check valve to prevent oil from flowing from the working oil supply path into the oil reservoir.

The hydraulic saildrive apparatus according to the present invention uses a hydraulic forward and reverse switching clutch for transmitting the rotation direction of the input shaft to the propeller shaft, the clutch being capable of changing the rotation direction between forward and reverse relative to the input shaft and suppressing noise during clutch engagement.

The hydraulic saildrive apparatus according to the present invention further comprises a first hydraulic pump that is driven by the input shaft, for supplying working oil and lubricating oil to the clutch from an oil reservoir, and a second hydraulic pump that is driven by the output shaft, for supplying lubricating oil or both working oil and lubricating oil to the clutch from an oil reservoir. With this structure, when the sailboat travels under power, lubricating oil is supplied from both the first hydraulic pump and the second hydraulic pump, and when the sailboat travels under sail, lubricating oil is supplied from the second hydraulic pump.

BEST MODE FOR CARRYING OUT THE INVENTION

The following describes the best mode for carrying out a hydraulic saildrive apparatus according to the present invention with reference to FIGS. 1 to 12. Throughout the figures, the same numerals are given to identical constituents.

Figure 1:
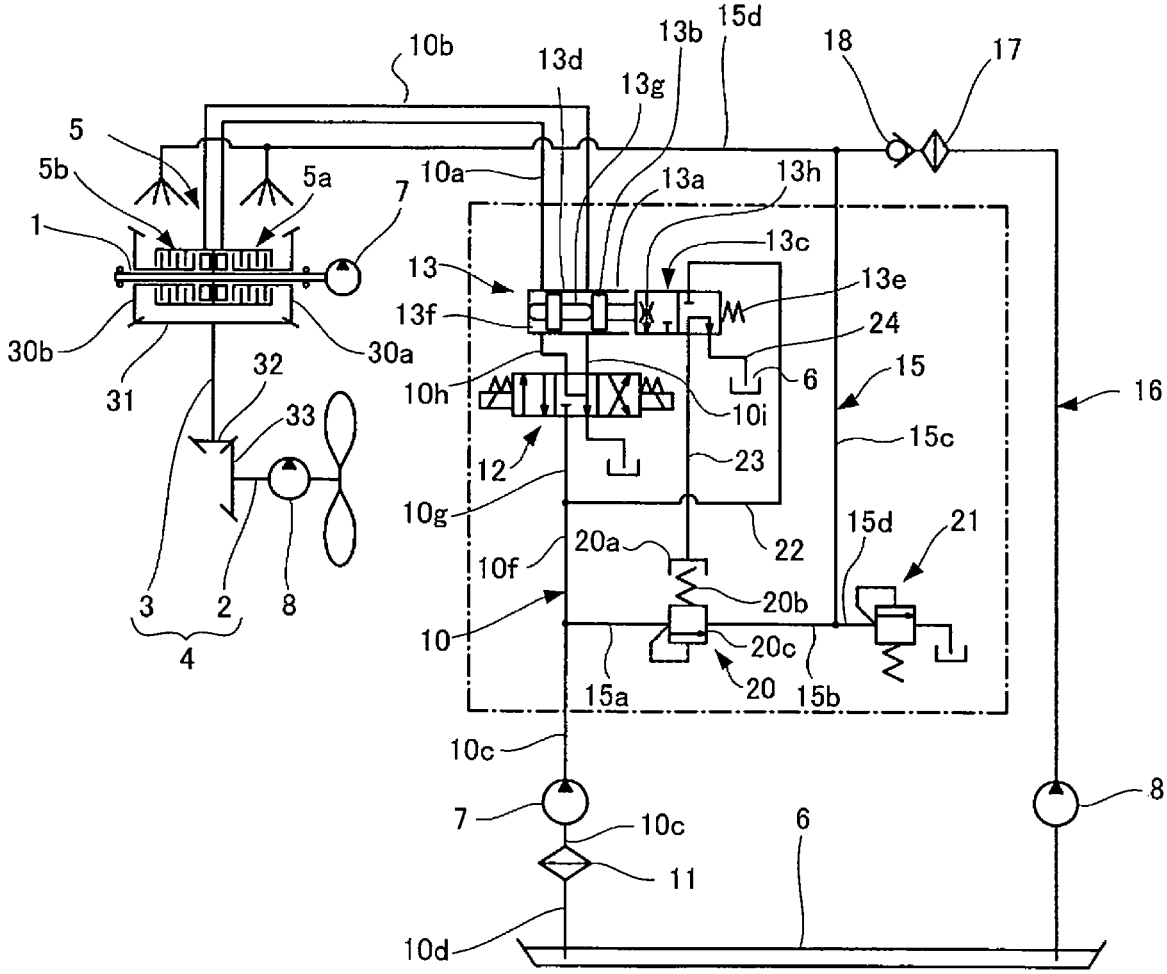
FIG. 1 is a hydraulic circuit diagram showing one embodiment of a hydraulic circuit of a hydraulic saildrive apparatus according to the present invention.

FIG. 1 is a hydraulic circuit diagram of a hydraulic saildrive apparatus. First, the following describes one embodiment of the hydraulic saildrive apparatus with reference to the hydraulic circuit of FIG. 1.

As shown in FIG. 1, the hydraulic saildrive apparatus has the following structure.

(1) An input shaft 1 drivably connected to the engine (not shown).

(2) An output shaft 4 containing a propeller shaft 2.

(3) A hydraulic wet multiplate clutch 5 for switching the forward and reverse propulsion of the output shaft 4, positioned between the input shaft 1 and the output shaft 4.

(4) A first hydraulic pump 7 driven by the input shaft 1 to provide working oil and lubricating oil to the clutch 5 from the oil reservoir 6.

(5) A second hydraulic pump 8 driven by the output shaft 4 to provide lubricating oil to the clutch 5 from the oil reservoir 6.

The first hydraulic pump 7 is integrated into a working oil supply path 10 for supplying working oil to the clutch 5 from the oil reservoir 6. The working oil supply path 10 includes a filter 11, an electromagnetic forward and reverse switching valve 12, and a two-position switching valve 13. The working oil supply path 10 is divided by a forward and reverse switching valve 12 into a forward propulsion oil path 10*a* connected to a forward clutch 5*a*, and a reverse propulsion oil path 10*b* connected to a reverse clutch 5*b*. The forward and reverse switching valve 12 serves to switch the oil path for supplying working oil between the oil paths 10*a* and 10*b*. The two-position switching valve 13 may be realized by a manual mechanical switching valve, though it is not shown in the figure.

The working oil supply path 10 is branched into a first lubricating oil supply path 15 for supplying lubricating oil to the clutch 5. The first lubricating oil supply path 15 is connected to a second lubricating oil supply path 16 for supplying lubricating oil from the oil reservoir 6 using the second hydraulic pump 8. The second lubricating oil supply path 16 includes a filter 17 and a check valve 18. The check valve 18 prevents the flow of the lubricating oil from the first lubricating oil supply path 15 into the direction of the second hydraulic pump 8.

The first lubricating oil supply path 15 includes a control valve 20 and a relief valve 21. The control valve 20 suppresses rapid engagement of the forward and reverse clutch 5 when the forward and reverse switching valve 12 is switched. The relief valve 21 sets the oil pressure level of the lubricating oil.

The control valve 20 is a kind of pressure regulating valve, and is operated by the two-position switching valve 13, which keeps the oil pressure level of the forward propulsion oil path 10*a* or the reverse propulsion oil path 10*b* of the working oil supply path 10 at a pilot pressure. The two-position switching valve 13 has a cylinder 13*a*, which includes a valve body 13*c*, a piston 13*d*, and a return spring 13*e*. A lateral face of the valve body 13*c* is provided with a piston 13*b*. The piston 13*d* can be freely connected relative to the piston 13*b* so as to divide the cylinder 13*a* into two portions.

As the pressure oil is supplied through the forward propulsion oil path 10*a* or the reverse propulsion oil path 10*b*, the pressure oil level of a pressure chamber 13*f* of the piston 13*d* or the pressure oil level of a pressure chamber 13*g* of the piston 13*b* in the cylinder 13*a* increases, and the corresponding piston 13*d* or 13*b*, respectively, is shifted to the right hand side as viewed in the figure against the return spring 13*e*, thereby switching the two-position switching valve 13. As a result, working oil that has been adjusted in flow rate by the restrictor 13*h* flows through the oil paths 22 and 23, and is inserted under pressure into the back chamber of the control valve 20. Then, the bias force of the relief spring 20*b* is gradually increased; in other words, the relief pressure of the control valve 20 is gradually increased by the piston 20*a* until a certain time has passed since the forward and reverse switching valve 12 was switched. Then, at the point where the bias force of the relief spring 20*b* becomes maximum, the pressure reaches the level at which the clutch 5*a* or the clutch 5*b* is completely engaged. When the working oil pressure becomes 0, the two-position switching valve 13 returns to the original position (the position shown in FIG. 1) due to the bias force of the return spring 13*e*. As a result, the flow of the working oil stops, the pressure oil that was inserted under pressure into the back chamber of the control valve 20 is discharged to the oil reservoir 6 through the two-position switching valve 13, and the control piston 20*a* of the control valve 20 returns to the original position.

More specifically, when the forward and reverse switching valve 12 is in the closed position (the position shown in FIG. 1), the two-position switching valve 13 is also in the closed position, and the pressure oil is not supplied to the back chamber of the control valve 20. Therefore, at this time, the spool 20*c* of the control valve 20 is greatly withdrawn, serving as a relief valve having a low relief pressure. On account of this, a part of the pressure oil supplied from the first hydraulic pump 7 through the oil path 10*c* of the working oil supply path 10 is discharged from the oil path 15*a* of the first lubricating oil supply path 15 due to the relief action of the control valve 20, and is released to the oil path 15*b* of the first lubricating oil supply path 15.

Furthermore, the pressure level of the oil flowing out of the control valve 20 into the oil path 15*b* of the first lubricating oil supply path 15 is set to a predetermined low pressure by the lubricating oil pressure setting relief valve 21.

Then, while the first hydraulic pump 7 is driven by the engine, the forward and reverse switching valve 12 is switched into the forward or reverse position using an electrical command. The pressure level of the working oil having started to flow in the oil path 10*a* or 10*b* of the working oil supply path 10 serves as a pilot pressure to cause the pistons 13*d* and 13*b* to move the two-position switching valve 13. This connects the oil path 22 and the oil path 23, and adjusts the flow rate by the restrictor 13*h* that is provided in the two-position switching valve 13, thereby inserting the working oil under pressure into the back chamber of the control valve 20 through the oil path 23. This pushes the spool forward and gradually increases the relief pressure in the control valve 20, thus slowly closing the lubricating oil supply path 15. As a reflective effect of this action, the working oil pressure values of the forward and reverse clutches 5*a* and 5*b* gradually increase. This prevents rapid engagement of the clutches. Finally, the clutches 5*a* and 5*b* are completely pressed by high pressure to fully relay power.

In response to the driving of the second hydraulic pump 8 by the propeller shaft 2, lubricating oil is supplied to the clutch 5 through the second lubricating oil supply path 16 and the oil path 15*d* of the first lubricating oil supply path 15. The oil pressure level of the pressure oil that is discharged from the second hydraulic pump 8 is adjusted by the relief valve 21 through the oil paths 15*c* and 15*d* of the first lubricating oil supply path 15.

The following explains the operation of a hydraulic saildrive apparatus having the foregoing hydraulic circuit.

When the input shaft 1 is driven by the engine (not shown) with the boat stopped, the rotation of the input shaft 1 drives the first hydraulic pump 7 so that the first hydraulic pump 7 pumps oil from the oil reservoir 6. Since the forward and reverse switching valve 12 in the original position is at a neutral position, the working oil supply path 10 is closed. The pressure oil pumped by the first hydraulic pump 7 flows from the oil path 10*c* of the working oil supply path 10 into the first lubricating oil supply path 15, and is supplied to the clutch 5 as lubricating oil. The check valve 18 prevents the pressure oil in the first lubricating oil supply path 15 from flowing into the second lubricating oil supply path 16. In this embodiment, the second lubricating oil supply path 16 contains the second hydraulic pump 8 made of a centrifugal pump or the like, which serves to substantially prevent the pressure oil from flowing out of the first lubricating oil supply path 15 into the oil reservoir 6 through the second lubricating oil supply path 16, so the check valve 18 can be omitted. Though it is not shown in FIG. 1, the lubricating oil supplied to the clutch 5 is brought back to the oil reservoir 6 through another oil path (not shown).

With the switching operation of the forward and reverse switching valve 12 into the forward or reverse position to engage the clutch 5, the working oil is gradually supplied to the forward and reverse clutch 5. With the supply of the working oil, the contact pressure of the clutch 5*a* or the clutch 5*b* gradually increases, and the clutch is completely engaged in a predetermined time.

As the forward or reverse clutch 5*a* or 5*b* is engaged, the rotation of the input shaft 1 is transmitted sequentially to the clutch 5*a* or 5*b*; a driving-side bevel gear 30*a* or 30*b* provided in the clutch 5; a driven-side bevel gear 31 engaged with the driving-side bevel gears 30*a* and 30*b*; a drive shaft 3 having the driven-side bevel gear 31 on its upper end and vertically extending as a part of the output shaft 4; the driving-side bevel gear 32 fixed to the lower end of the drive shaft 3; the driven-side bevel gear 33 engaged with the driving-side bevel gear 32, having a greater diameter than the driving-side bevel gear 32; and the propeller shaft 2 having the driven-side bevel gear 33 on its one end and extending horizontally as a part of the output shaft 4. This transmission produces engine power which moves the boat with forward or reverse propulsion.

While traveling under power, the first hydraulic pump 7 and the second hydraulic pump 8 are driven together. The first hydraulic pump 7 supplies working oil and lubricating oil to the clutch 5. The second hydraulic pump 8 supplies lubricating oil.

When the engine is stopped to operate the sailboat under sail, the first hydraulic pump 7 is stopped in response to the stopping of the input shaft 1, which suspends the supply of lubricating oil from the first hydraulic pump 7 to the clutch 5. However, since the output shaft 4 keeps rotating due to the sail-powered propulsion, the second hydraulic pump 8 remains driven by the output shaft 4. As such, the lubricating oil is supplied to the clutch 5 by the second hydraulic pump 8 while traveling under sail. The control valve 20 prevents the pressure oil that is supplied from the second hydraulic pump 8 to the oil path 15*d* of the first lubricating oil supply path 10 from flowing out of the oil path 15*c* and 15*b* of the first lubricating oil supply path 15 into the working oil supply path 10.

Figure 2:
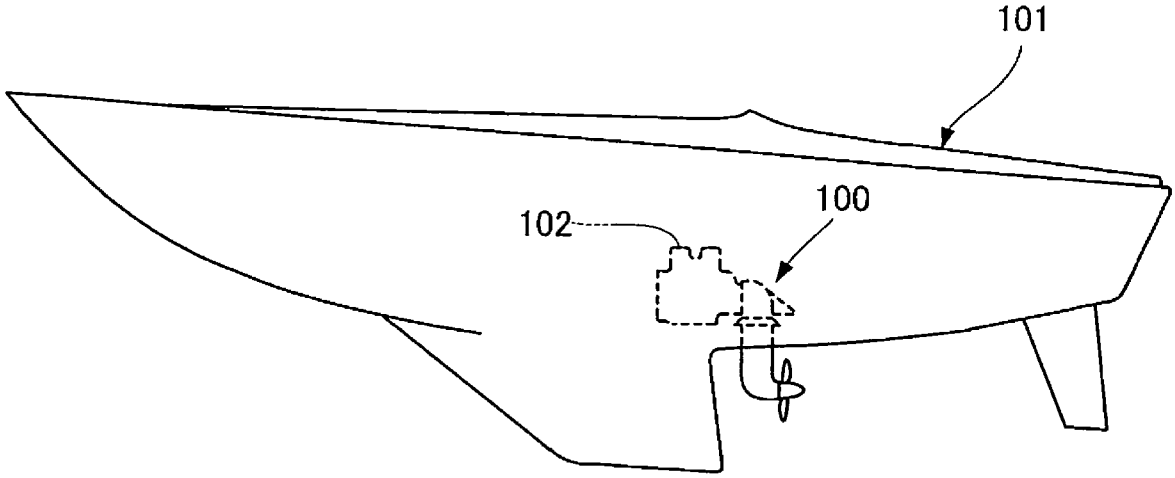
FIG. 2 is a lateral view showing the appearance of a sailboat equipped with the hydraulic saildrive apparatus according to the present invention.
Figure 3:
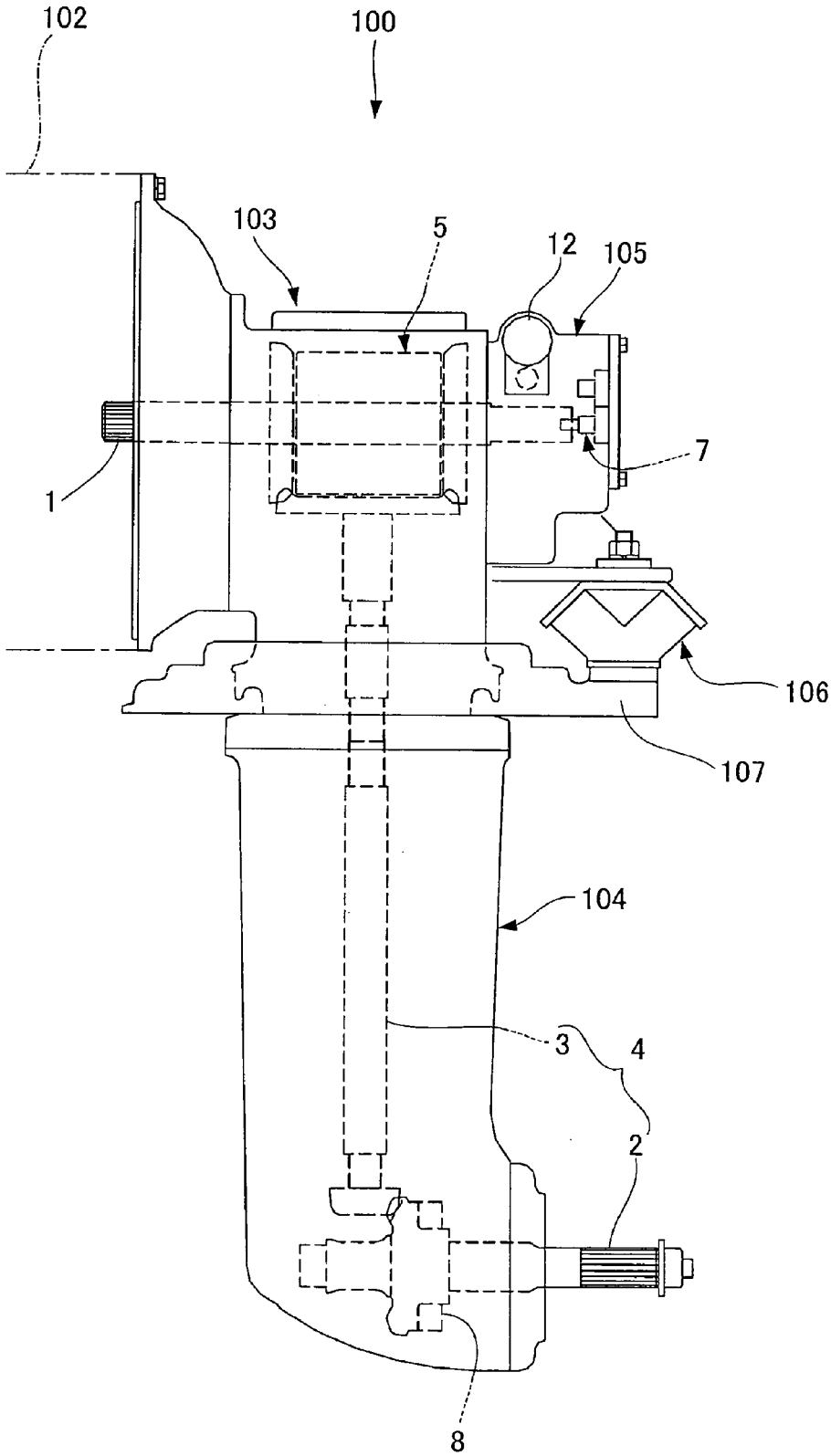
FIG. 3 is a lateral view showing a magnified view of the hydraulic saildrive apparatus of FIG. 2.
Figure 4:
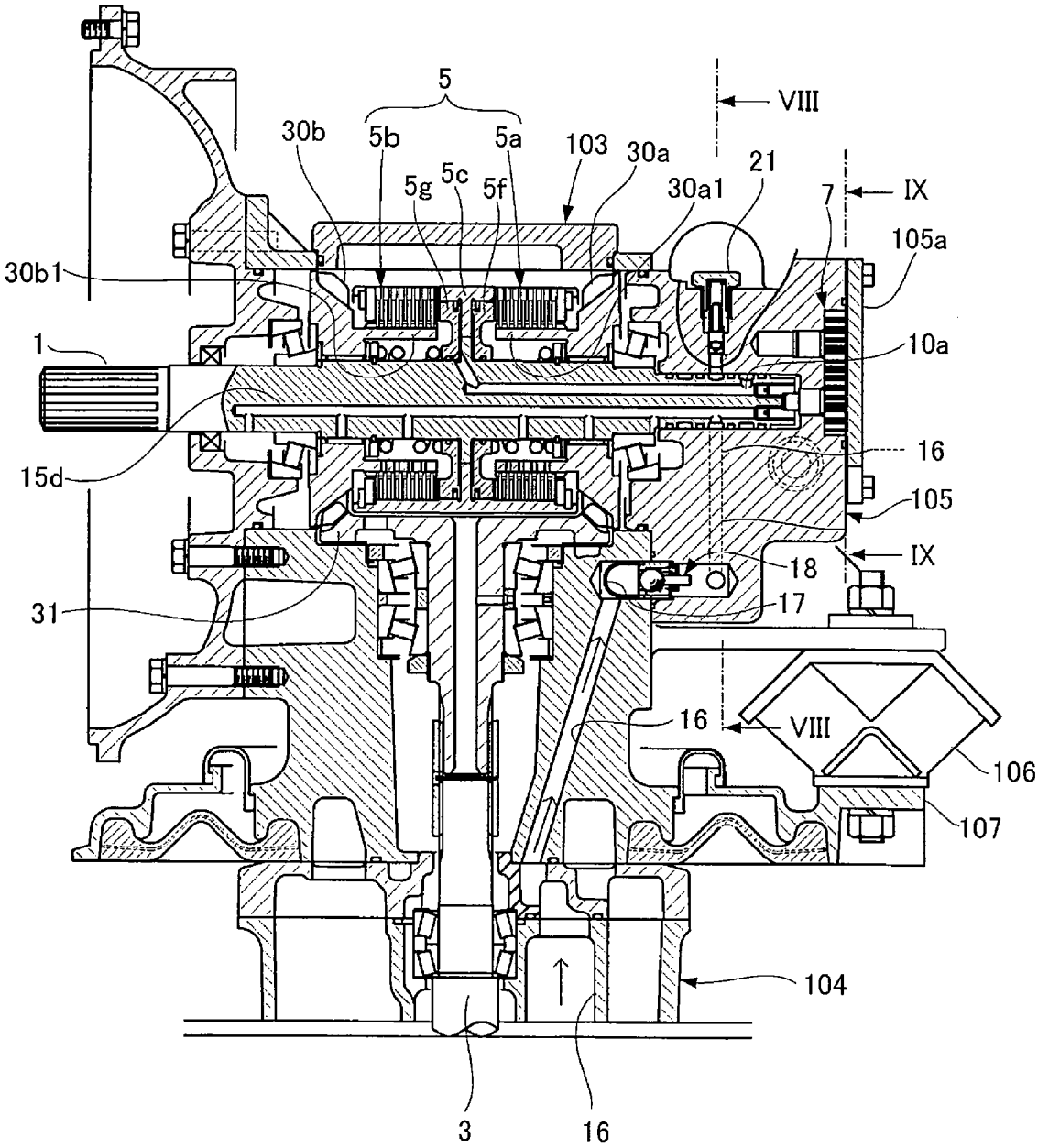
FIG. 4 is a longitudinal lateral view showing the upper internal structure of the hydraulic saildrive apparatus of FIG. 3.
Figure 5:
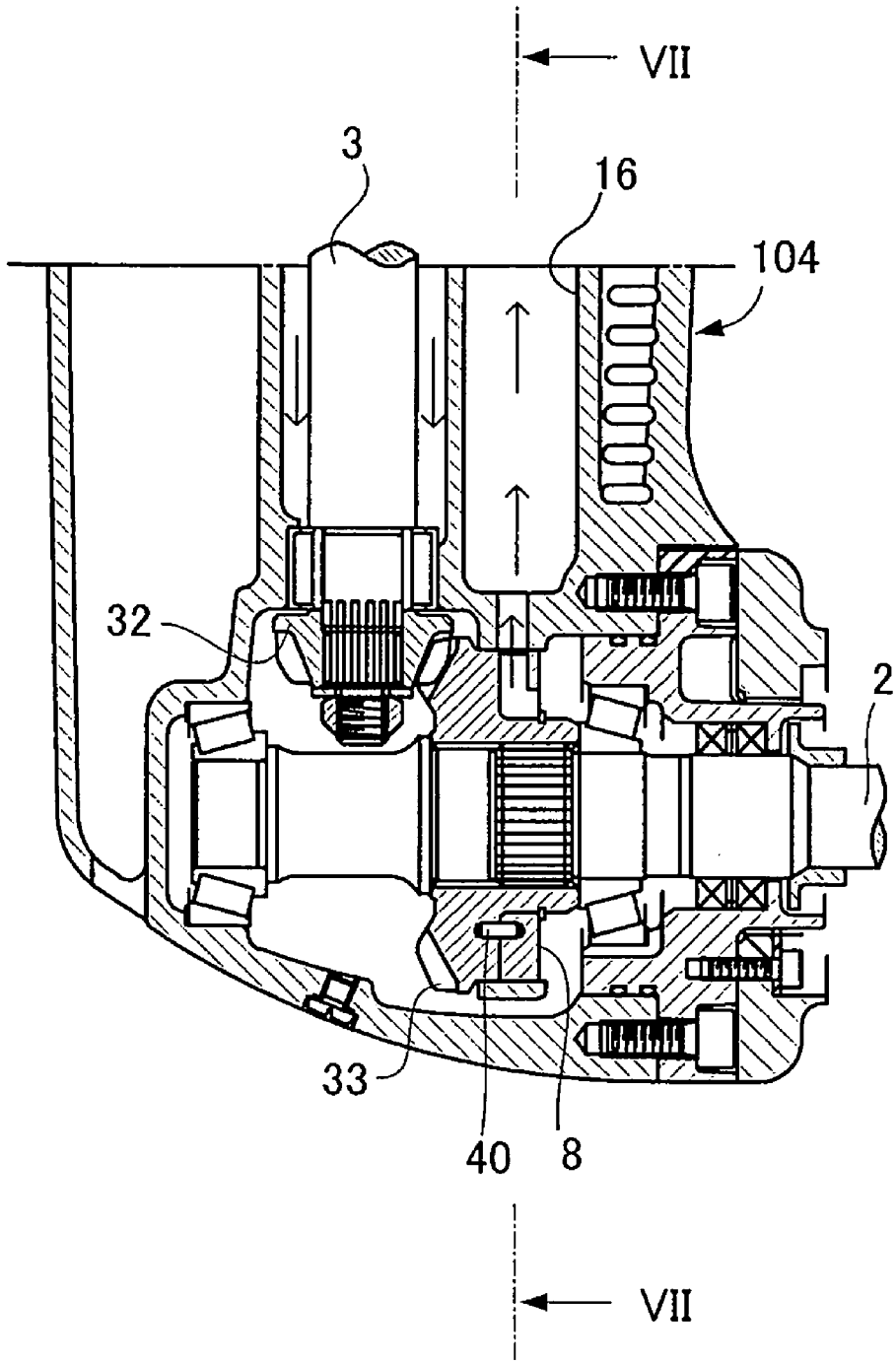
FIG. 5 is a longitudinal lateral view showing the lower internal structure of the hydraulic saildrive apparatus of FIG. 4.
Figure 6:
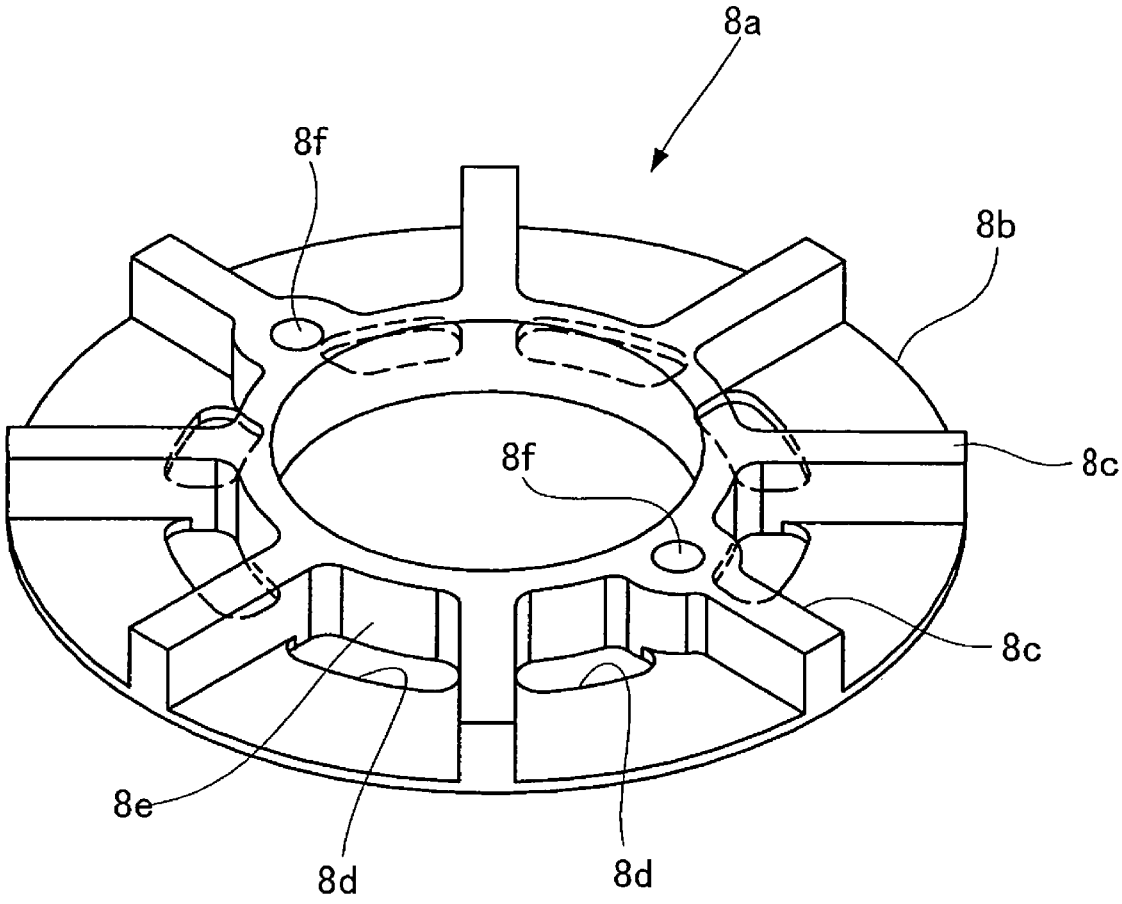
FIG. 6 is a perspective view showing the major component of the second hydraulic pump.
Figure 7:
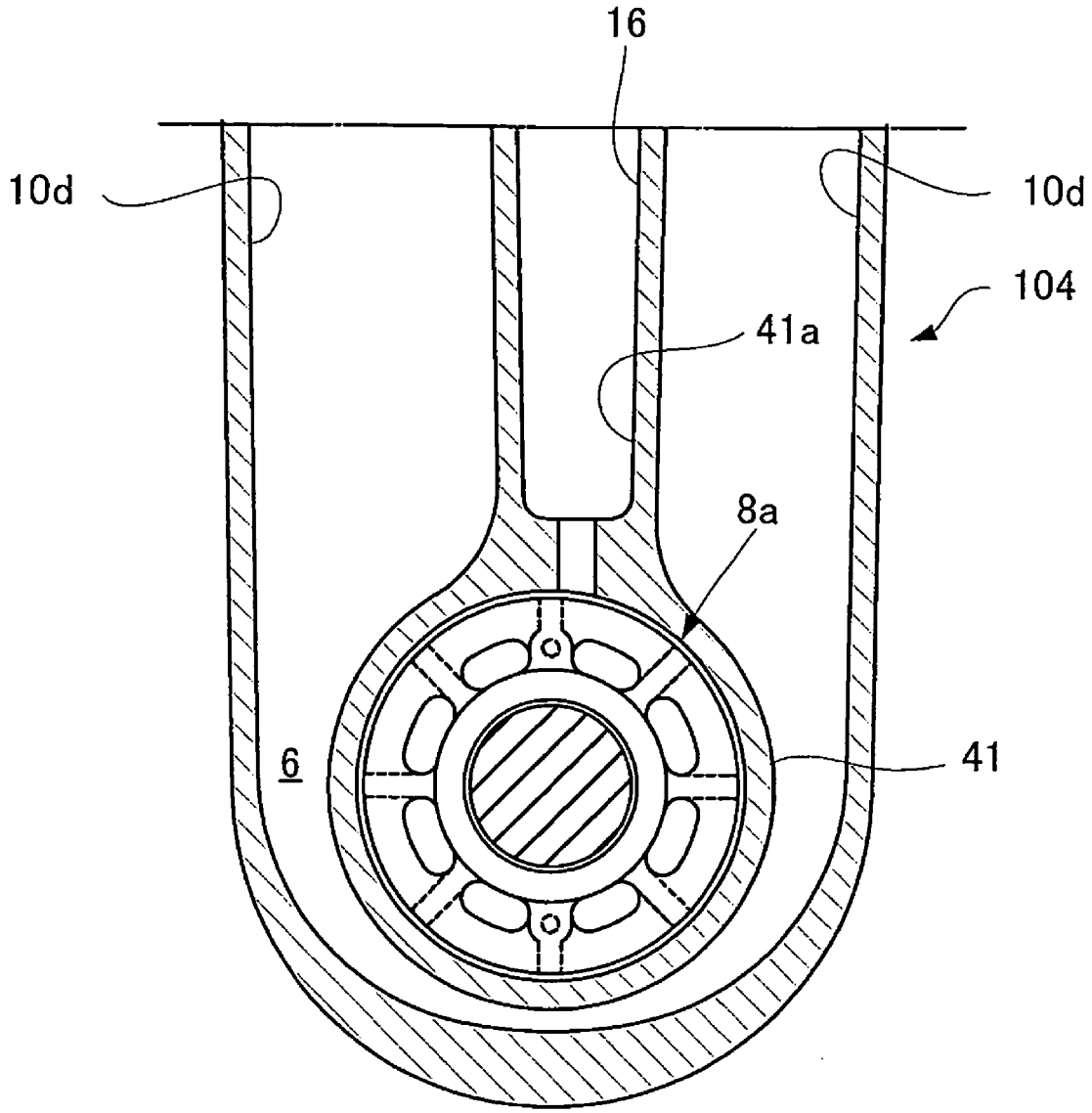
FIG. 7 is a cross-sectional view, taken along the line VII-VII of FIG. 5.
Figure 8:
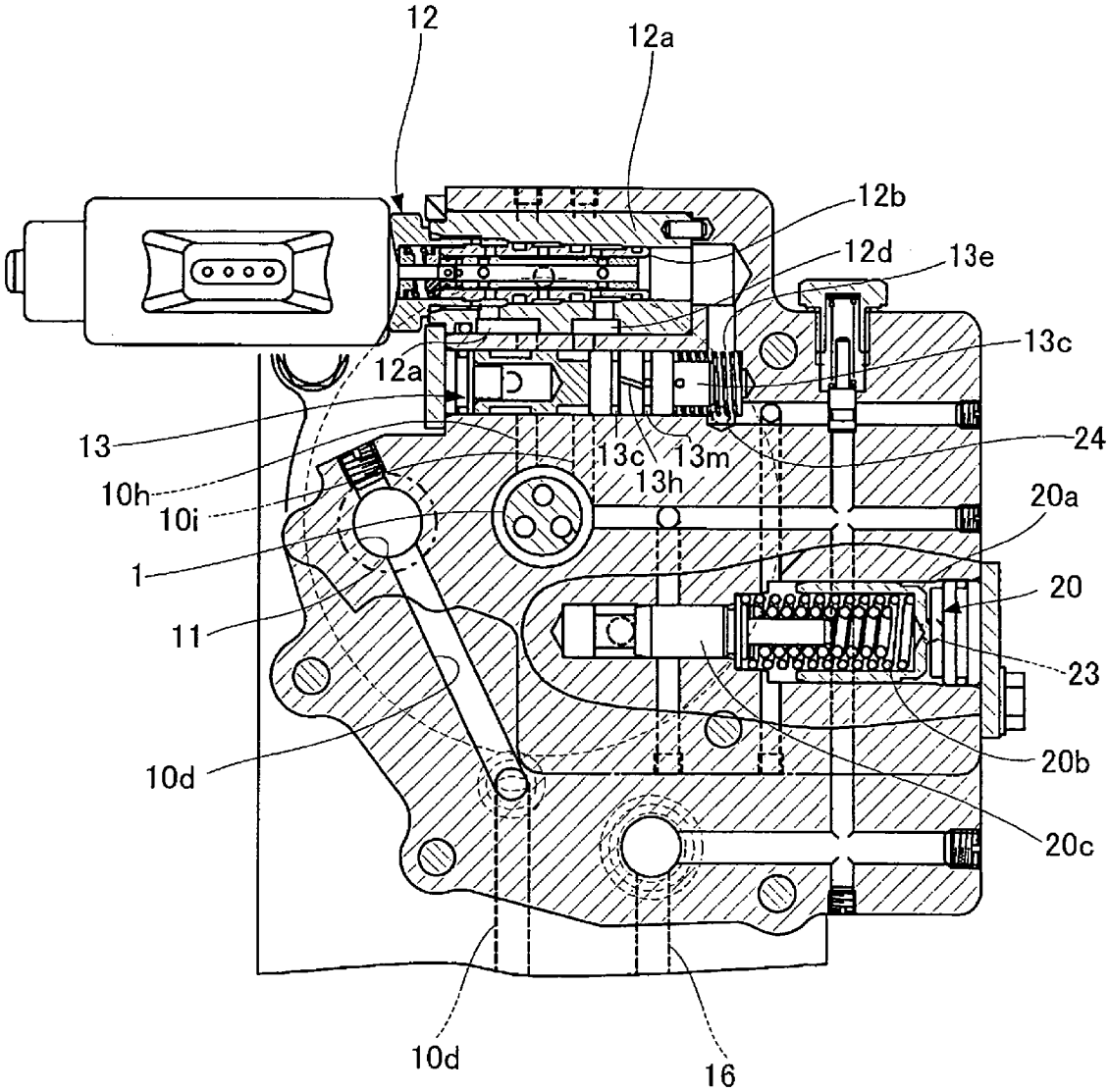
FIG. 8 is a cross-sectional view, taken along the line VIII-VIII of FIG. 4.
Figure 9:
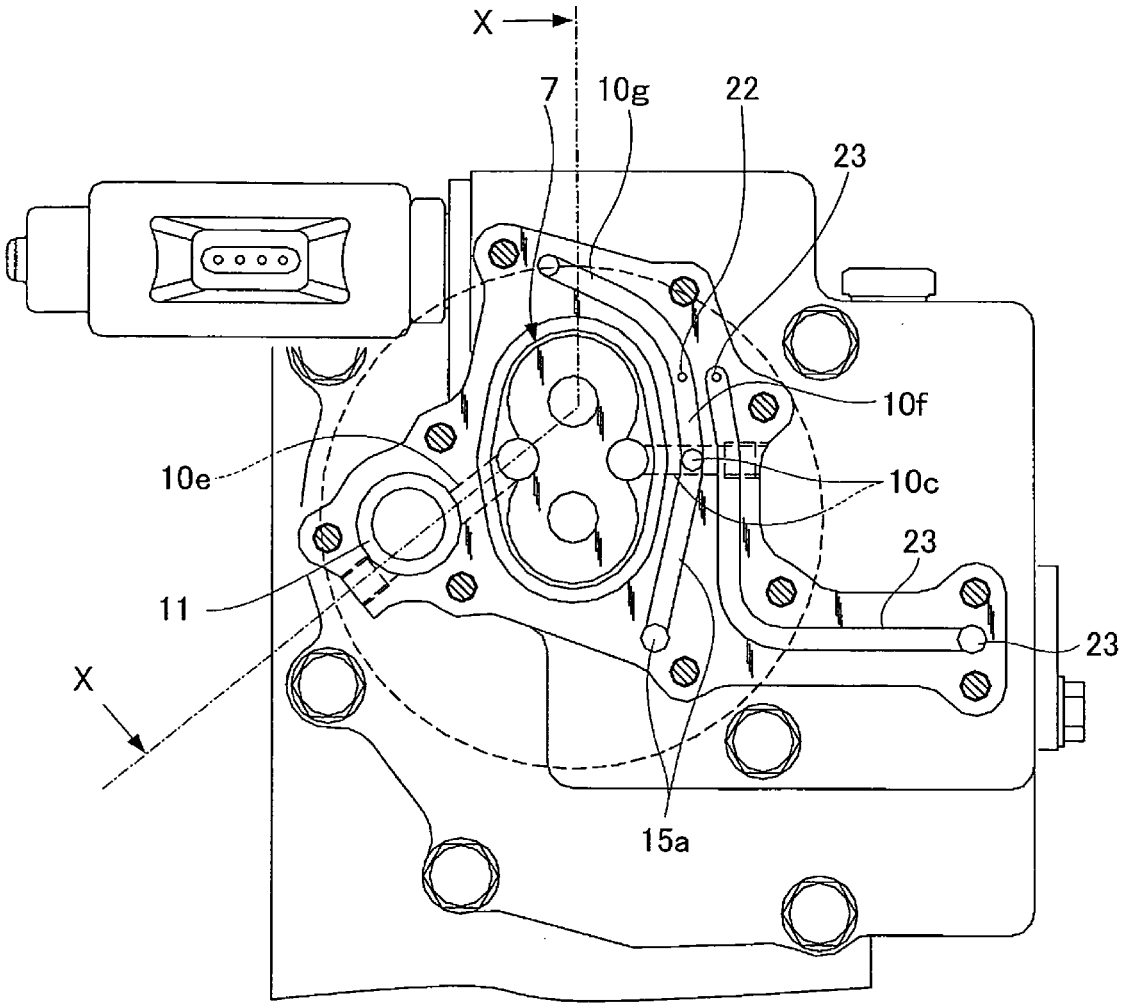
FIG. 9 is a cross-sectional view, taken along the line IX-IX of FIG. 4.
Figure 10:
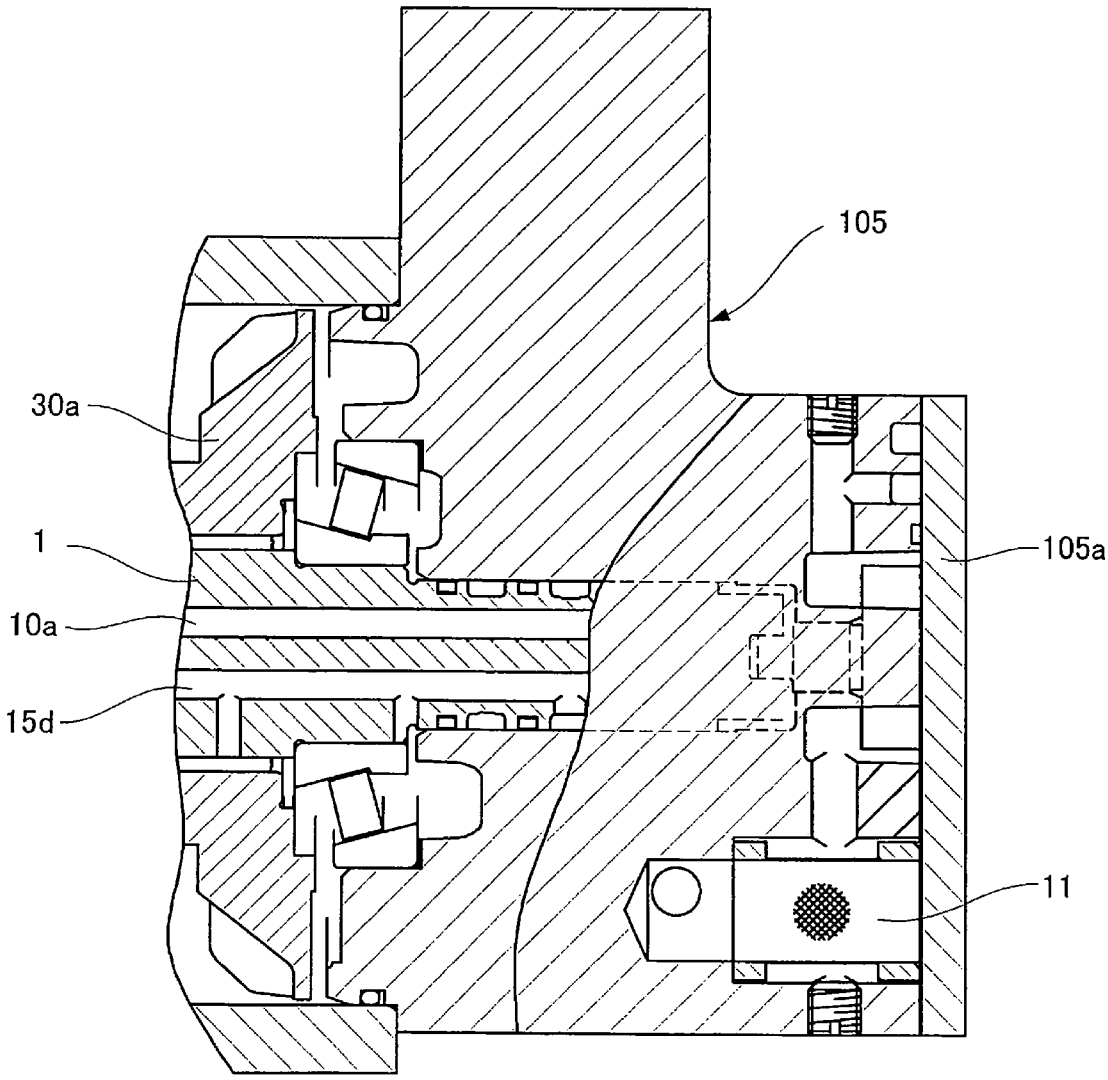
FIG. 10 is a cross-sectional view, taken along the line X-X of FIG. 9.

The following explains a hydraulic saildrive apparatus having the foregoing hydraulic circuit, with reference to FIGS. 1 to 10. In FIGS. 2 to 10, the same numerals are given to constituents identical to those in FIG. 1. FIG. 2 is a lateral view showing the appearance of a sailboat equipped with the hydraulic saildrive apparatus. FIG. 3 is a lateral view showing the appearance of the hydraulic saildrive apparatus. FIG. 4 is a longitudinal lateral view showing the upper internal structure of the hydraulic saildrive apparatus of FIG. 3. FIG. 5 is a longitudinal lateral view showing the lower internal structure of the hydraulic saildrive apparatus of FIG. 4. FIG. 6 is a perspective view showing a major component of a second hydraulic pump. FIG. 7 is a cross-sectional view, taken along the line VII-VII of FIG. 5. FIG. 8 is a cross-sectional view, taken along the line VIII-VIII of FIG. 4. FIG. 9 is a cross-sectional view, taken along the line IX-IX of FIG. 4. FIG. 10 is a cross-sectional view, taken along the line X-X of FIG. 9.

As shown in FIG. 2, the hydraulic saildrive apparatus 100 is connected to the engine 102 provided inside a boat 101, with its lower part projecting from the boat's bottom. As shown in FIG. 3, the hydraulic saildrive apparatus 100 includes an upper unit 103, and a lower unit 104 connected to the upper unit 103.

The upper unit 103 incorporates the input shaft 1 combined with the engine 102, the forward and reverse clutch 5 supported by the input shaft 1, and the like. The oil unit 105 fixed to the back of the upper unit 103 incorporates the first hydraulic pump 7, the forward and reverse switching valve 12, and the like. The lower unit 104 incorporates the output shaft 4 made up of the drive shaft 3 and the propeller shaft 2, the second hydraulic pump 8 attached to the propeller shaft 2, and the like. The hydraulic saildrive apparatus 100 is attached to the annular seal flange 107 fixed to a supporting base (not shown) provided in the boat's bottom, with a rubber cushion 106 disposed therebetween.

In the upper unit 103, the input shaft 1 is horizontally held as shown in FIG. 4. One end of the input shaft 1 is projected from the upper unit 103 to be combined with the engine. The other end of the input shaft 1 is combined with one of the gears of the gear pump constituting the first hydraulic pump 7. When the input shaft 1 is rotated in response to the driving of the engine, the first hydraulic pump 7 is brought into operation.

The forward and reverse clutch 5 supported by the input shaft 1 has the following structure.

(1) A plurality of forward and reverse pressure plates implanted in the input shaft 1 fixed to the outer drum 5*c*

(2) A forward driving bevel gear 30*a* and a reverse driving bevel gear 30*b* rotatably engaged with the input shaft 1.

(3) A plurality of clutch plates implanted in the inner drums 30*a*1 and 30*b*1, respectively extending from the forward driving bevel gear 30*a* and the reverse driving bevel gear 30*b*.

(4) Pistons 5*f* and 5*g* for pressing the pressure plates in response to a supply of working oil from the working oil supply path 10 provided in the input shaft 1.

The driving bevel gears 30*a* and 30*b* are engaged with the driven bevel gear 31. The driven bevel gear 31 is connected by means of a spline engagement with the drive shaft 3 projecting from the upper end of the lower unit 104.

As shown in FIG. 5, the drive shaft 3 vertically extends inside the lower unit 104. The driving bevel gear 32 fixed to the lower end of the drive shaft 3 is engaged with the driven bevel gear 33. The driven bevel gear 33 is connected by means of a spline engagement with the propeller shaft 2 horizontally held in the lower unit 104.

An impeller of the centrifugal pump constituting the second hydraulic pump 8 is fixed to one lateral face of the driven bevel gear 33. As shown in the perspective view of FIG. 6, the impeller 8*a* has the following structure. A plurality of impeller blades 8*c* are formed so as to project from the cover plate 8*b*. The suction inlet 8*d* is formed between two adjacent impeller blades 8*c* on the cover plate 8*b*. Two pin holes 8*f* are formed on the boss 8*e* of the impeller 8*a*, allowing the impeller 8*a* to be coupled with the driven bevel gear 33 using a pin 40 (FIG. 5).

As is clearly shown in FIG. 7, the impeller 8*a* is surrounded by a ring-shaped housing 41 integrated in the inner side of the lower unit 104. A communicating path 41*a*, which extends to the second lubricating oil supply path 16 provided in the lower unit 104, is formed in a part (upper part) of the housing 41. As shown in FIG. 7, in the lower unit 104, the second lubricating oil supply path 16 extends upward from an opening 41*a* along the central axis of the width (thickness) of the lower unit 104. Further, in the lower unit 104, the oil path 10*d* of the working oil supply path 10 is formed on both sides of the second lubricating oil supply path 16, extending upward from the oil reservoir 6.

The second lubricating oil supply path 16 running inside the lower unit 104 extends to the upper unit 103 through the joint surface of the lower unit 104 and the upper unit 103, narrowing the cross section of the flow path, and extends further to the oil unit 105. In the joint surface of the upper unit 103 and the oil unit 105, the oil filter 17 and the check valve 18 are disposed in the second lubricating oil supply path 16.

The second lubricating oil supply path 16 inside the oil unit 105 is connected to the relief valve 21, merging into the oil path 15*d* of the first lubricating oil supply path 15 that runs inside the input shaft 1 in parallel with the axis of the input shaft 1. Accordingly, the lubricating oil flowing in the second lubricating oil supply path 16 is supplied from the oil path 15*d* to a clutch, gear, bearing and the like through the hole formed in the peripheral face of the input shaft 1. The lubricating oil supplied to the clutch, etc., through the second lubricating oil supply path 16 flows downward by passing through the gap around the driven bevel gear 31 or the gap around the drive shaft 3, into the oil reservoir 6.

As shown in FIG. 7, the oil path 10*d* of the working oil and lubricating oil path 10 extends inside the lower unit 104, upward from the oil reservoir 6, and passes through the joint surface (not shown) of the lower unit 104 and the upper unit 103. As shown in FIG. 8, the oil path 10*d* in the upper unit 103 is connected to the oil path 10*d* in the oil unit 105. After further passing through the filter 7 (see FIG. 10) provided in the oil unit 105, the oil path 10*d* opens to the suction end of the gear pump constituting the first hydraulic pump 7 through the oil path 10*e* of the working oil and lubricating oil path 10, as shown in FIG. 9. The oil path 10*d* further extends from the discharge end of the gear pump, passing through the oil paths 10*f* and 10*g*, which are formed of grooves covered by the cover 105*a* (FIG. 4), and also through the sleeve 12*a* of the electromagnetic spool valve constituting the forward and reverse switching valve 12, and is then connected to a circumferential groove formed on the outer peripheral face of the spool 12*b*. From the circumferential groove, the oil path 10*d* passes through the openings 12*c* and 12*d* of the sleeve 12*a*, and further passes through the oil path 10*h* or 10*i* through the two-position switching valve 13. As shown in FIG. 4, the oil path 10*d* leads to the oil path 10*a* provided in the input shaft 1 (FIG. 4 only shows the forward propulsion oil path 10*a*), and communicates with the piston chamber of the clutch 5.

The pressure oil discharged from the first hydraulic pump 7 enters the oil path 22 through the oil paths 10*c* and 10*f*, and is discharged to the peripheral groove 13*m* formed on the outer peripheral face of the spool constituting the valve body 13*c* of the two-position switching valve 13. When working oil is supplied from the forward and reverse switching valve 12 to the pressure chamber 13*f* of the piston 13*d* or the pressure chamber 13*g* of the piston 13*b*, the piston 13*d* or the piston 13*b* pushes the valve body 13*c* of the two-position switching valve 13 to the right of FIG. 8 against the elastic force of the return spring 13*e*. With the movement of the valve body 13*c* of the two-position switching valve 13 to the right of the figure, the pressure oil supplied from the oil path 22 enters the peripheral groove 13*n* of the valve body 13*c*. Then, the pressure oil passes through the restrictor 13*h* formed of an outer circumferential groove of the valve body 13, and is supplied to the peripheral groove 13*m*. Therefrom, the pressure oil flows through oil path 23 shown in FIG. 9, to the oil path 23 made up of the cover 105*a* and the groove formed in the oil unit 105. The pressure oil is then supplied to the back chamber of the control valve 20, applying hydraulic pressure to the control piston 20*a*.

Note that the second hydraulic pump is attached to the propeller shaft in the foregoing embodiment; however, it may be attached to the drive shaft 3.

Figure 11:
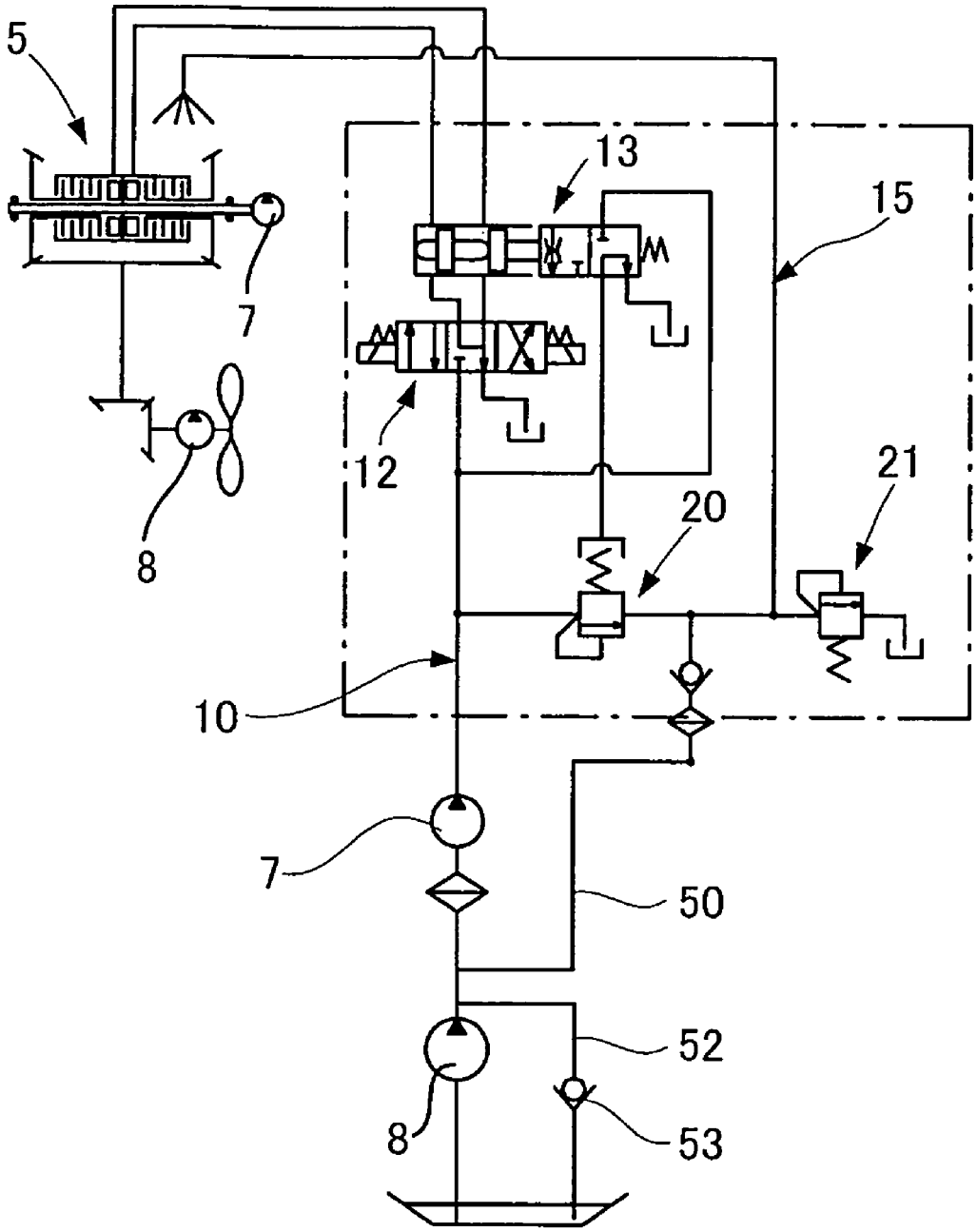
FIG. 11 is a hydraulic circuit diagram showing another embodiment of the hydraulic saildrive apparatus according to the present invention.

FIG. 11 is a hydraulic circuit diagram showing another embodiment of the hydraulic saildrive apparatus according to the present invention. The embodiment shown in FIG. 11 uses a different layout of the second hydraulic pump 8 from that of FIG. 1.

The hydraulic circuit shown in FIG. 11 is identical to the hydraulic circuit in FIG. 1 in that the lubricating oil supply path 15 provided by the first hydraulic pump 7 is branched from the working oil supply path 10 provided by the first hydraulic pump 7, at a point downstream from the first hydraulic pump 7.

In the hydraulic circuit shown in FIG. 11, the second hydraulic pump 8 is formed at a location in the working oil supply path 10 that is upstream from the first hydraulic pump 7. The first bypass oil path 50 branched from the working oil supply path 10 at a point between the first hydraulic pump 7 and the second hydraulic pump 8 is connected to the lubricating oil supply path 15. The first bypass oil path 50 includes a first check valve 51 that prevents the lubricating oil in the lubricating oil supply path provided by the first hydraulic pump 7 from flowing into the second hydraulic pump 8. The second bypass oil path 52 branched from the working oil supply path 10 at a point between the first hydraulic pump 7 and the second hydraulic pump 8 is connected to the oil reservoir 6. The second bypass oil path 52 includes a second check valve 53 that prevents the oil from the working oil supply path 10 from flowing into the oil reservoir 6.

Though it is not shown in the figure, the lower unit may have a smaller number of oil paths when the foregoing hydraulic circuit is used. More specifically, the lower unit may have a single oil path instead of the oil paths 16, 10*d*, and 10*f* of FIG. 7.

Figure 12:
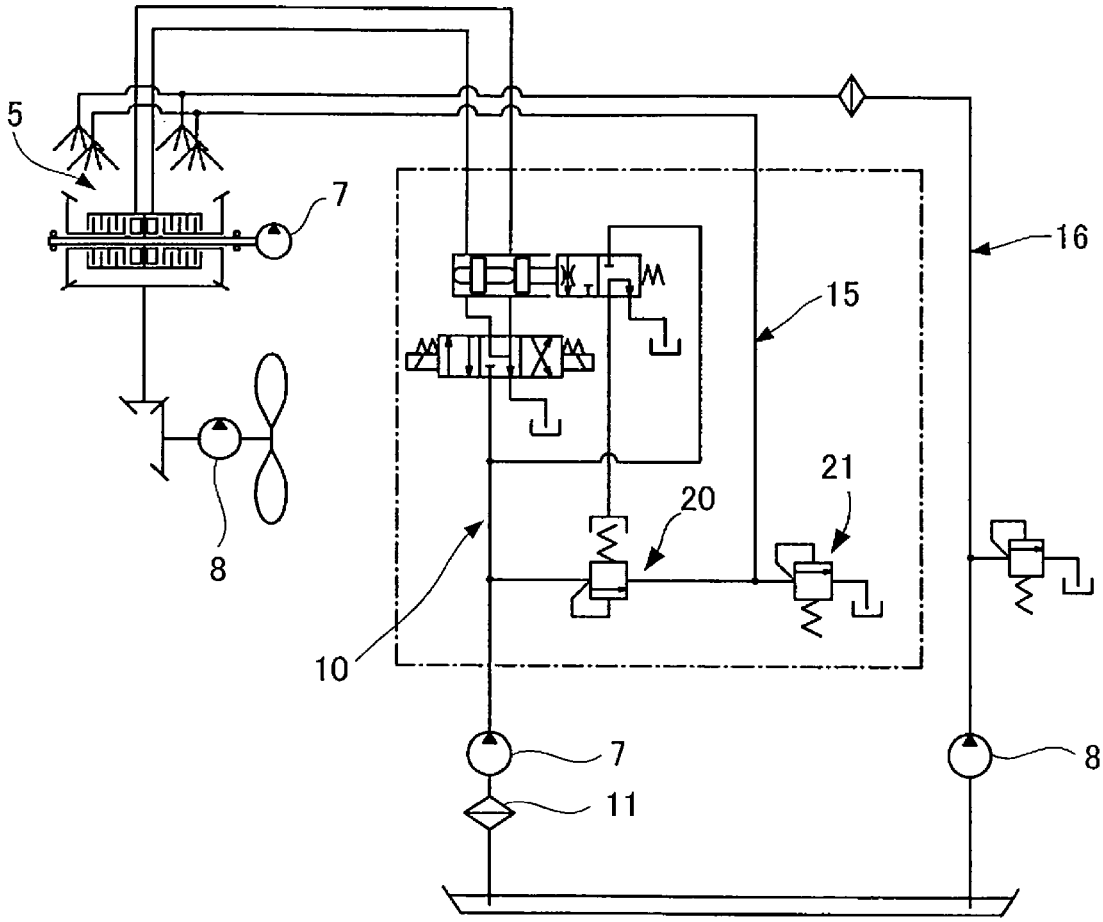
FIG. 12 is a hydraulic circuit diagram showing still another embodiment of the hydraulic saildrive apparatus according to the present invention.

FIG. 12 is a hydraulic circuit diagram showing still another embodiment of the hydraulic saildrive apparatus according to the present invention.

The hydraulic circuit shown in FIG. 12 is identical in structure to the hydraulic circuit diagram of FIG. 1, except that the lubricating oil supply path 16 provided by the second hydraulic pump 8 is independent from the lubricating oil supply path 15 provided by the first hydraulic pump 7.

The invention claimed is:

1. A hydraulic saildrive apparatus comprising:

an upper unit having an input shaft connected to an engine inside a boat;

a lower unit having an output shaft including a propeller shaft, wherein a lower portion of the lower unit protrudes from a bottom of the boat;

a first hydraulic pump driven by the input shaft, for supplying a working oil and a lubricating oil to the clutch from an oil reservoir; and a second hydraulic pump driven by the output shaft, for supplying at least lubricating oil to the clutch from an oil reservoir, wherein the upper unit is provided with a hydraulic forward and reverse switching clutch for transmitting the rotation direction of the input shaft to the propeller shaft, wherein the clutch is capable of changing the rotation direction between forward and reverse relative to the input shaft, and the output shaft is configured to rotate when the engine is driven and when the engine is stopped while the boat travels under sail.

2. A hydraulic saildrive apparatus comprising:

an upper unit having an input shaft connected to an engine inside a boat, wherein the upper unit is provided with a hydraulic forward and reverse switching clutch for transmitting the rotation direction of the input shaft to the propeller shaft, and wherein the clutch is capable of changing the rotation direction between forward and reverse relative to the input shaft;

a lower unit having an output shaft including a propeller shaft, wherein a lower portion of the lower unit protrudes from a bottom of the boat;

a first hydraulic pump driven by the input shaft, for supplying a working oil and a lubricating oil to the clutch from an oil reservoir;

a second hydraulic pump driven by the output shaft, for supplying at least lubricating oil to the clutch from an oil reservoir;

a second lubricating oil supply path connected to a first lubricating oil supply path for supplying lubricating oil to the clutch by the first hydraulic pump, wherein the second lubricating oil supply path extends from the second hydraulic pump; and a check valve provided in the second lubricating oil supply path, to prevent flowing of the lubricating oil from the first lubricating oil supply path into the direction of the second hydraulic pump.

3. A hydraulic saildrive apparatus comprising:

an upper unit having an input shaft connected to an engine inside a boat, wherein the upper unit is provided with a hydraulic forward and reverse switching clutch for transmitting the rotation direction of the input shaft to the propeller shaft, and wherein the clutch is capable of changing the rotation direction between forward and reverse relative to the input shaft;

a lower unit having an output shaft including a propeller shaft, wherein a lower portion of the lower unit protrudes from a bottom of the boat;

a first hydraulic pump driven by the input shaft, for supplying a working oil and a lubricating oil to the clutch from an oil reservoir;

a second hydraulic pump driven by the output shaft, for supplying at least lubricating oil to the clutch from an oil reservoir, wherein a lubricating oil supply path provided by the first hydraulic pump is branched from a working oil supply path provided by the first hydraulic pump, at a point downstream from the first hydraulic pump;

the second hydraulic pump is provided in a part of the working oil supply path, at a point upstream from the first hydraulic pump;

a first bypass oil path is branched from the working oil supply path, at a point between the first hydraulic pump and the second hydraulic pump, wherein the first bypass oil path is connected to the lubricating oil supply path;

the first bypass oil path includes a first check valve to prevent flowing of the lubricating oil from the lubricating oil supply path provided by the first hydraulic pump into the direction of the second hydraulic pump;

a second bypass oil path is branched from the working oil supply path, at a point between the first hydraulic pump and the second hydraulic pump, wherein the second bypass oil path is connected to the oil reservoir; and the second bypass oil path includes a second check valve to prevent oil flowing from the working oil supply path into the oil reservoir.

* * * * *